US005988968A

United States Patent [19]

Hansmeier et al.

[11] Patent Number: 5,988,968

[45] Date of Patent: Nov. 23, 1999

[54] METHOD OF AND APPARATUS FOR APPLICATION OF ADHESIVE

[75] Inventors: Robert Hansmeier, Stemwede/Hollwede; Harald Grewe, Rahden, both of Germany

[73] Assignee: Kolbus GmbH & Co, KG, Rahden, Germany

[21] Appl. No.: 09/060,980

[22] Filed: Apr. 15, 1998

[30] Foreign Application Priority Data

Apr. 24, 1997 [DE] Germany ..... 197 17 192

[51] Int. Cl.[6] ..... B42C 9/00

[52] U.S. Cl. ..... 412/8; 412/37; 412/11

[58] Field of Search ..... 412/1, 4, 8, 11, 412/13, 14, 37, 36; 118/258, 679, 668; 156/1

[56] References Cited

U.S. PATENT DOCUMENTS 4,925,354 5/1990 Cote .
5,443,639 8/1995 Hawkes ..... 412/37
5,702,220 12/1997 Combs ..... 412/11 X
5,876,170 3/1999 Geiser ..... 412/8

FOREIGN PATENT DOCUMENTS 0 189 580 B1 10/1990 European Pat. Off. .
966 742 9/1957 Germany .
2262138 6/1973 Germany .

*Primary Examiner*—Willmon Fridie, Jr.
*Attorney, Agent, or Firm*—Alix, Yale & Ristas, LLP

[57] ABSTRACT

An adhesive film which reliably completely covers the spine side of a book block, prior to mating with a cover, is applied by an applicator roller which is controlled to rotate at speeds which are a function of the book block linear velocity and the location of the book block relative to the roller. The applicator rotational speed is determined from stored information and, depending on book block location, will either be greater or less than book block velocity.

20 Claims, 2 Drawing Sheets

METHOD OF AND APPARATUS FOR APPLICATION OF ADHESIVE

BACKGROUND OF THE INVENTION (1) Field of the Invention

The present invention relates to the manufacture of books and, particularly, to improvements in the adhesive bonding of "hard" covers to inner books. More specifically, this invention is directed to apparatus for applying a uniform coating of adhesive to the shaped back of a book block prior to the mating of the book block with a cover and, especially, to devices for exercising control over the glue applicator roller of such adhesive applying apparatus. Accordingly, the general objects of the present invention are to provide novel and improved methods and apparatus of such character.

(2) Description of the Prior Art

In the manufacture of books on a commercial scale, attachment of the cover to the back of the book block is accomplished by establishment of an adhesive bond. Thus, the gauzing, sticking-back and capitalling of a book requires the application of an adhesive to the shaped back, i.e., the spine side, of the book block. The adhesive is customarily transferred to the book block by means of a profiled applicator roller which is caused to contact the book block back.

In a typical adhesive application procedure, a profiled applicator roller contacts a "scoop" roller which, in turn, is partly immersed in a reservoir containing molten adhesive. Adhesive is transferred from the reservoir to the profiled applicator roller by the "scoop" roller and, in turn, a film of glue is deposited to the book back as the profiled applicator roller rolls along the back of the book block. In one example of the prior art, the profiled applicator roller is movable relative to the back of the book blocks in synchronism with the movement of book blocks as the blocks are transported by a conveying device with their backs directed upwardly.

Experience has proven that the creation of a film of adhesive which extends over the full surface of a shaped book block back cannot be ensured solely through the use of a profiled applicator roller. This inability to achieve gluing over the full surface of the book block arises from the fact that it is impossible for the profile of the applicator roller to exactly match the contour of the backs of all of the book blocks to be processed.

To amplify the above remarks, when the profile of the applicator roller is "flatter" than that of the book block back, a film of glue having approximately the shape of a parabola will be created on the book block and, most importantly, no adhesive will be deposited in the corner regions of the book block back. Conversely, if the applicator roller has a profile which is "steeper" than the shape of a book block back, a region in the center of the block back may receive no adhesive.

A procedure for overcoming the above-briefly discussed deficiencies associated with the use of prior art profiled adhesive applicator rollers is disclosed in European Patent 0 189 580. In accordance with this procedure, during the time the applicator roller is in contact with the book block back, the rotational speed thereof is increased. Restated, European Patent 0 189 580 suggests that the adhesive applicator roller be caused to rotate such that a region on its periphery which is in contact with the book block be moving at a speed which is greater than speed of advance of the book block by a factor of 10–20%. Additionally, in the interest of preventing contamination of the cut face of the book block at the trailing end thereof in the direction of book block movement, this European patent teaches the necessity of reducing the rotational speed of the applicator roller concurrently with its being lifted clear of the book block back.

Implementation of the improved technique described immediately above has required complex, and thus expensive, apparatus. The complexity of this apparatus has been increased by the provision of mechanisms which allow compensation for the height of the book blocks being processed. Such hardware complexity inherently has an adverse effect on reliability.

SUMMARY OF THE INVENTION

The present invention overcomes the above-discussed and other deficiencies and disadvantages of the prior art and, in so doing, provides relatively uncomplicated and reliable apparatus for obtaining a uniform, full-surface application of adhesive to the back of a book block while avoiding the contamination, by glue, of the cut face which adjoins the back of the book block. Apparatus in accordance with the present invention implements an improvement of the above, briefly described method of European Patent 0 189 580.

In accordance with the present invention, book blocks are transported toward the adhesive applicator with a cut face thereof defining a rear reference edge. The adhesive applicator comprises a roller which is driven so as to rotate about a stationary axis. The conveyed book blocks are cyclically advanced, i.e., book block movement is in steps, and the speed of the drive of the adhesive-applicator roller is controlled such that the roller will rotate at an elevated mean rotational speed relative to the book block, for the purpose of applying the film of adhesive, and at a reduced mean rotational speed relative to the book block, to ensure against trailing cut face contamination. The changes in mean rotational speed are commanded when the applicator roller is at defined distances from the rear reference edge of the book block. These distances remain the same regardless of book height.

In accordance with a preferred embodiment of the invention, the adhesive applicator roller is provided with an independent drive. The rotational speed of the applicator roller will be switched between an idling speed and the aforementioned elevated and reduced mean rotational speeds in synchronism with book block movement. At least the elevated and reduced mean rotational speeds are preprogrammed, i.e., are determined by reference to stored parameter sets, and are selected as a function of book block transport velocity. A first of these parameter sets is thus commensurate with elevated mean rotational speeds, i.e., velocities of the adhesive coated surface of the applicator roller which exceed the velocity of the book block. The second parameter set is commensurate with mean rotational speeds of the book block contacting face of the applicator roller which are less than the linear velocity of the book block but greater than an idle speed of the applicator roller.

BRIEF DESCRIPTION OF THE DRAWINGS

The present invention may be better understood, and its numerous objects and advantages will become apparent to those skilled in the art, by reference to the accompanying drawings wherein.

DESCRIPTION OF THE DISCLOSED EMBODIMENT

Figure 1:
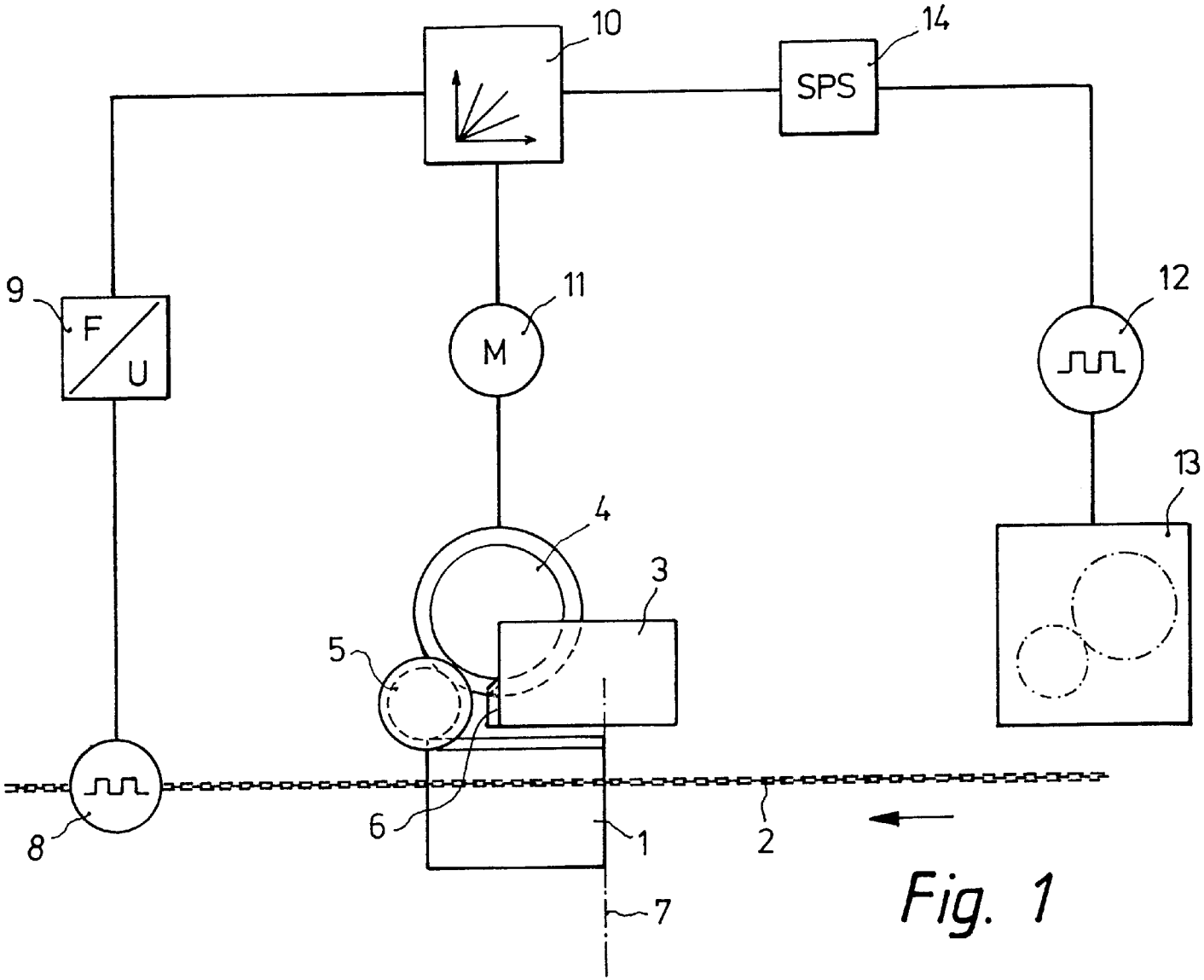
FIG. 1 is a block diagram which schematically illustrates apparatus for exercising control over a book block adhesive applicator roller in accordance with the invention.

With reference to FIG. 1, the apparatus which is schematically illustrated applies a film of adhesive to the back of a book block 1 which is advanced cyclically by a conveyor 2. The conveyor 2 may, for example, be a book block transport chain on which are mounted clamps which engage the oppositely disposed sides of the book block 1. The adhesive applying mechanism consists of a reservoir 3, in which a glue is maintained in a molten state, a "scoop" roller 4 and an adhesive applicator roller 5. The applicator roller 5 is driven so as to rotate, with its adhesive carrying surface in contact with an advancing book block 1, about a fixed axis. This rotational contact delivers a film of glue to the back of the book block. The glue will, of course, be transferred from reservoir 3 to applicator roller 5 by the "scoop" roller 4 which is partly immersed in the molten glue.

As represented by the broken line concentric with the maximum circumference of roller 5, the applicator roller is constructed as a profiled roller which is adapted to the contour of the back of the book block 1. Applicator roller 5 will typically be comprised of an elastic material, for example rubber, and thus within limits will adjust itself to the varying shapes of the backs of the advancing book blocks 1. The adhesive applicator roller 5 and "scoop" roller 5 are caused to rotate in opposite directions and with a prescribed distance between the generally complementary shaped facing surfaces thereof. The spacing between the rollers 4 and 5 may be varied slightly to ensure that applicator roller 5 acts on "scoop" roller 4 in a scraping manner. Control over the thickness of the film of adhesive applied to the book block 1 will be exercised in a known manner such as, for example, by adjusting the position of a scraper 6 which cooperates with "scoop" roller 4.

As noted above, the book blocks 1 are supported in a clamped manner by the book block transport, i.e., the chain drive 2. In accordance with the invention, clamping is accomplished such that the rearwardly disposed cut faces of the book blocks define a moving reference plane or edge 7. The positions of the clamp plates of the conveyor are known and thus the location of the reference edges may be monitored. Additionally, the book blocks are clamped such that the shaped backs thereof will be situated at a constant level. The thus clamped book blocks are advanced in a cyclical manner and move past the applicator roller 5 which, as noted above, rotates about an axis which is also situated at a constant level.

The conveyor speed, i.e., the linear velocity of a clamped book block moving with chain 2, is measured by a sensor 8. In the disclosed embodiment, sensor 8 provides a train of pulses having a repetition rate commensurate with transport speed. The pulses provided by sensor 8 are converted to an analog signal, i.e., a voltage, by a frequency to voltage converter 9. In one reduction to practice, converter 9 provided a ten (10) volt output signal at a maximum book block transport speed commensurate with the processing of sixty (60) book blocks per minute, i.e., a block transport speed of sixty cycles/minute. The output voltage of converter 9 is delivered to a voltage to frequency converter 10 which, in the manner to be described below, provides an energization signal for the applicator drive motor 11. Motor 11, via appropriate gearing, imparts rotation to "scoop" roller 4 and applicator roller 5. The rotational speed of the output shaft of motor 11, and thus the velocity of the surface of roller 5, will be a function of the frequency of the energizing signal applied to motor 11 by circuit 10.

Figure 2:
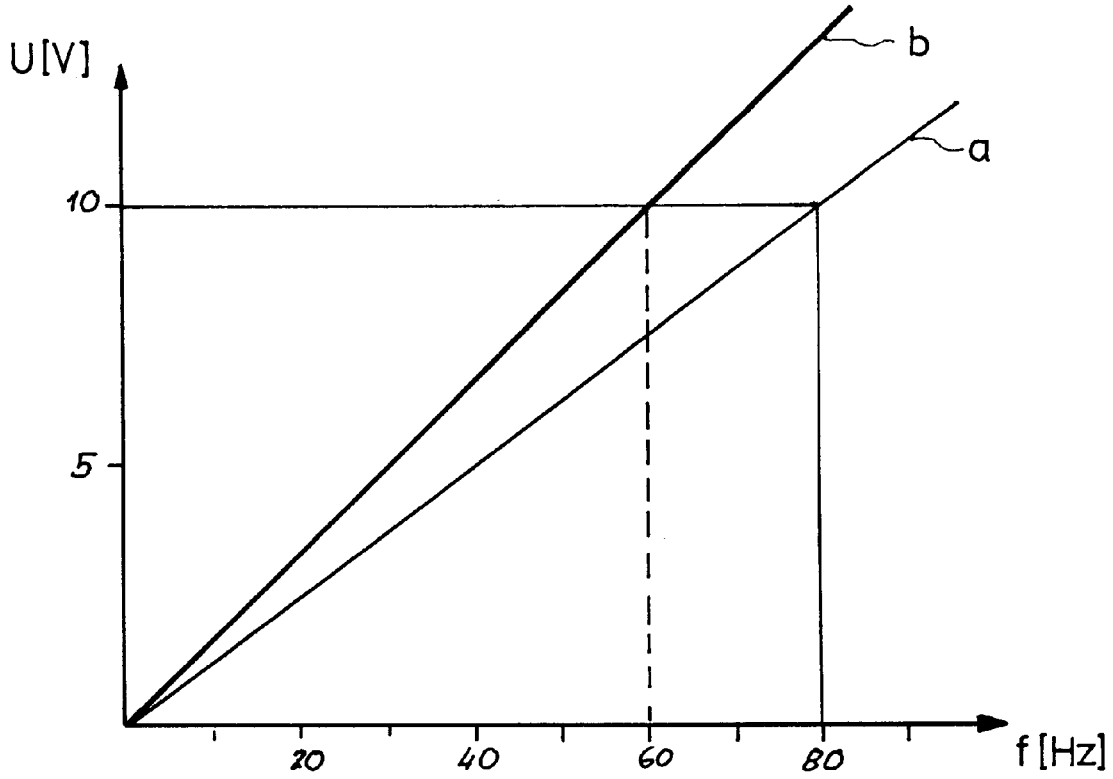
FIG. 2 is a graphical depiction of the stored parameter sets which determine the rotational speeds of the applicator roller of the apparatus of FIG. 1.

The alternating output voltage of frequency conversion circuit 10 will be at a frequency commensurate with an idling or jogging speed of motor 11 or a frequency selected from a stored parameter set as a function of both the measured conveyor speed and the location of the reference edge 7 of a book block relative to the applicator roller 5. Referring to FIG. 2, in the example being described where the maximum conveyor speed resulted in the application of a ten volt signal to circuit 10, an 80 Hz energizing signal will be applied to motor 11 when stored parameter set a is selected and a 60 Hz energizing signal will be applied to motor 11 when stored parameter set b is selected. The selection of parameter set a will result in the applicator roller 5 being driven such that the book block contacting surface thereof will have a mean overspeed relative to the linear velocity of a book block 1, i.e., the surface portion of roller 5 which contacts the back of book block 1 will be moving faster than the book block will be advancing. Conversely, if parameter set b is selected, an underspeed condition will be created, i.e., motor 11 will cause roller 5 to be driven such that the surface portion of the roller which contacts the book block will be moving slower than the advancing book block. The manner in which the circuit 10 is caused to switch between generation of an output frequency commensurate with the idle speed or either of parameter sets a and b will be described below.

The book block transport, i.e., the chain 2 in the disclosed embodiment, is driven by a main drive, i.e., a gear unit, which is indicated schematically at 13. The angle of rotation of this main drive is measured by a sensor 12. In the example being described, one complete revolution of the main drive gear for transport 2 corresponds to one cycle, i.e., the movement of one book block through the adhesive application station. Since the locations of the evenly spaced clamp plates on the conveyor are known, and the tailing faces in the direction of conveyor movement of the clamped book blocks are aligned with the clamp defined reference edges 7, the output of sensor 12 may be calibrated to be a measure of the spacing of a moving reference plane 7, i.e., the upstream face of a book block, from a fixed parallel plane through the axis of rotation of applicator roller 5.

The output of sensor 12 is applied as the input signal to a switching control circuit 14. Switching control circuit 14 will, pursuant to stored information, provide switching control signals which are delivered to conversion circuit 10. For example, when the measured angle of rotation of the conveyor drive is in the range of 50° to 180°, circuit 10 will be commanded to select an output frequency determined by parameter set a. Thereafter, during a measured angle of main drive rotation in the range of 180° to 240°, the output of circuit 10 will be switched so that circuit 10 will provide a drive motor energizing voltage at a frequency selected from parameter set b. The output frequency of circuit 10 will then be switched to a level commensurate with the idling speed of roller 5 and this speed will be maintained until the 50° condition is again detected by sensor 12 during the next cycle.

The angle of the conveyor main drive at which the output of circuit 10 is switched to a frequency commensurate with parameter set p is selected such that the speed of applicator roller 5 will always be increased before contact is established with the back of a book block 1. Typically, this speed increase will occur with a spacing of about 10 to 20 mm between the leading edge of a book block 1 of the largest format, i.e., the tallest book to be processed, and the point of initial contact between roller 5 and a book block back side. The switchover to an output frequency commensurate with parameter set b will typically occur when reference edge 7 is about 40 to 50 mm upstream of the plane in which the axis of rotation of roller 5 lies. The idle speed of roller 5 is selected such that the viscosity of the glue will be maintained during periods when the transport chain is not moving.

As will be obvious to those skilled in the art, the switching control circuit 14 may be a programmed controller, i.e., an SPS, which provides output signals having three levels or states which are determined by the "value" of the input signal provided thereto by sensor 12. Circuit 14 may, for example, include a counter for accumulating pulses generated by sensor 14 in response to rotation of a gear in drive unit 13. The output signals of control circuit 14 will, of course, always be changed in the same sequence. Voltage to frequency conversion circuit 10 will, in response to a first level or state of the output signal of controller 14, produce an output frequency commensurate with a preselected idling, i.e., jogging, speed of motor 11. The presence of either of the other two output signals provided by controller 14 will determine whether the level of the voltage to be converted to a drive frequency by circuit 10 should be selected from curve a or curve b, and the voltage selected will in either case be a function of the output voltage level of frequency to voltage converter 9.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for the application of adhesive to the spine sides of book blocks, the book blocks being advanced along a transport path by a conveyor with the spine sides thereof facing outwardly, there being a predetermined spacing between successive of the transported blocks, the adhesive being delivered to the book block spine sides via an applicator roller having a surface which contacts the book block spine sides, the improvement comprising:

a variable speed drive responsive to drive control signals for imparting rotation to the applicator roller, said drive being mechanically isolated from the conveyor;

first sensor coupled to the conveyor for generating a signal commensurate with the linear velocity of the book blocks;

a second sensor for generating signals commensurate with the spacing between the trailing edge of an advancing book block and a point along the transport path where there is contact between the applicator roller surface and the book block spine side, said point of contact being located downstream of the book block trailing edge in the direction of book block movement; and a drive control signal generator, said drive control signal generator being responsive to said signal commensurate with book block velocity and said signals commensurate with spacing, said drive control signal generator providing drive control output signals commensurate with desired rotational speeds of the applicator roller, a first of said drive control signals being commensurate with a velocity of the applicator roller surface which exceeds the book block velocity, a second of said drive control signals being commensurate with a velocity of the applicator roller surface which is less than the book block velocity, said first and second drive control signals being varied as a function of said signal commensurate with book block velocity, the output of said drive control signal generator switching from said first to said second of said drive control signals in response to the generation by said second sensor of a signal commensurate with a first predetermined spacing between said book block trailing edge and the applicator roller, said first predetermined spacing being less than the height of the book block, the output of said drive control signal generator switching back to said first drive control signal in response to the generation by said second sensor of a signal commensurate with a second predetermined spacing between said book block trailing edge and the applicator roller.

2. The apparatus of claim 1 wherein said drive control signal generator stores information commensurate with applicator roller desired rotational speed as a function of book block linear velocity, said stored information including a first parameter set corresponding to the applicator roller surface velocity exceeding the book block velocity and a second parameter set corresponding to the applicator roller surface velocity being less than the book block velocity.

3. The apparatus of claim 1 wherein said second spacing is greater than the height of the book block.

4. The apparatus of claim 1 wherein said drive control signal generator provides a third drive control signal commensurate with an idle speed of the applicator roller, said idle speed corresponding to an applicator roller surface velocity which is less than that commensurate with said second drive control signal, the output of said drive control signal generator being switched to said third drive control signal in response to the generation by said second sensor of a signal commensurate with a third spacing between the trailing edge of an advancing book block and the applicator roller, said third drive control signal always being provided after a said second drive control signal and at a time when there is no contact between the applicator roller and a book block spine side.

5. The apparatus of claim 1 wherein motion is imparted to the conveyor by a rotary drive and wherein said second sensor measures the angle of rotation of said rotary drive.

6. The apparatus of claim 1 wherein said variable speed drive comprises a frequency responsive electric motor and wherein the position of axis of rotation of the applicator roller relative to the transport path is fixed.

7. The apparatus of claim 2 wherein said second spacing is greater than the height of the book block.

8. The apparatus of claim 2 wherein said drive control signal generator provides a third drive control signal commensurate with an idle speed of the applicator roller, said idle speed corresponding to an applicator roller surface velocity which is less than that commensurate with said second drive control signal, the output of said drive control signal generator being switched to said third drive control signal in response to the generation by said second sensor of a signal commensurate with a third spacing between the trailing edge of an advancing book block and the applicator roller, said third drive control signal always being provided after a said second drive control signal and at a time when there is no contact between the applicator roller and a book block spine side.

9. The apparatus of claim 3 wherein said drive control signal generator provides a third drive control signal commensurate with an idle speed of the applicator roller, said idle speed corresponding to an applicator roller surface velocity which is less than that commensurate with said second drive control signal, the output of said drive control signal generator being switched to said third drive control signal in response to the generation by said second sensor of a signal commensurate with a third spacing between the trailing edge of an advancing book block and the applicator roller, said third drive control signal always being provided after a said second drive control signal and at a time when there is no contact between the applicator roller and a book block spine side.

10. The apparatus of claim 7 wherein said drive control signal generator provides a third drive control signal commensurate with an idle speed of the applicator roller, said idle speed corresponding to an applicator roller surface velocity which is less than that commensurate with said second drive control signal, the output of said drive control signal generator being switched to said third drive control signal in response to the generation by said second sensor of a signal commensurate with a third spacing between the trailing edge of an advancing book block and the applicator roller, said third drive control signal always being provided after a said second drive control signal and at a time when there is no contact between the applicator roller and a book block spine side.

11. The apparatus of claim 2 wherein motion is imparted to the conveyor by a rotary drive and wherein said second sensor measures the angle of rotation of said rotary drive.

12. The apparatus of claim 3 wherein motion is imparted to the conveyor by a rotary drive and wherein said second sensor measures the angle of rotation of said rotary drive.

13. The apparatus of claim 4 wherein motion is imparted to the conveyor by a rotary drive and wherein said second sensor measures the angle of rotation of said rotary drive.

14. The apparatus of claim 10 wherein motion is imparted to the conveyor by a rotary drive and wherein said second sensor measures the angle of rotation of said rotary drive.

15. The apparatus of claim 14 wherein said variable speed drive comprises a frequency responsive electric motor and wherein the position of axis of rotation of the applicator roller relative to the transport path is fixed.

16. A method of applying an adhesive film to the surface of the spine side of a shaped book block comprising the steps of:

engaging a book block in the clamp of a conveyor, the conveyor defining a transport path, the engaged book block being held with its spine side at a predetermined level, the engaged book block also being held with a trailing side edge thereof substantially aligned with a moving reference plane;

delivering a molten adhesive to the profiled surface of an adhesive applicator roller, the axis of rotation of the roller being located relative to the transport path such that contact will be established between the profiled surface of the roller and the book block spine side;

advancing the engaged block along the transport path to thereby cause the book block to move toward and past the applicator roller;

measuring the linear velocity of the advancing book block;

monitoring the spacing between the trailing side edge of the book block and a point along the transport path where there is contact between the applicator roller and the book block spine side;

selecting a speed of rotation for the applicator roller as a function of the measured linear velocity of the book block and the monitored spacing;

causing the applicator roller to rotate such that its profiled surface will travel at a first speed when the monitored spacing is commensurate with a first predetermined distance between the book block trailing side edge and said point, said first predetermined distance being larger than the height of the book block, and said first speed being greater than the linear velocity of the book block; and reducing the applicator roller surface speed to a second speed in response to the spacing between the book block trailing side edge and said predetermined point reaching a second predetermined distance, said second predetermined distance being less than the height of the book block, and said second speed being less than said linear velocity of the book block.

17. The method of claim 16 further comprising:

imparting rotation to the applicator roller such that the profiled surface thereof will travel at a third speed when not caused to rotate at either of said first and second speeds, said third speed being less than said second speed.

18. The method of claim 16 wherein said step of selecting comprises:

storing information corresponding to desired differences between applicator roller rotational speed and book block velocity as a function of book block velocity, said stored information comprising a first set of values for roller surface speeds exceeding block velocity and a second set of values for roller surface speeds less than block velocity;

referencing either the first or second set of values as a function of monitored spacing; and choosing a value, from the reference set of values as a function of measured book block velocity.

19. The method of claim 18 further comprising:

imparting rotation to the applicator roller such that the profiled surface thereof will travel at a third speed when not caused to rotate at either of said first and second speeds, said third speed being less than said second speed.

20. The method of claim 19 wherein the step of monitoring spacing includes:

determining the angular orientation of a rotary drive of the conveyor.

* * * * *